US008696055B2

(12) United States Patent
Stolarz et al.

(10) Patent No.: US 8,696,055 B2
(45) Date of Patent: Apr. 15, 2014

(54) HIGHCHAIR WITH ADJUSTABLE TRAY AND SEAT HEIGHT

(75) Inventors: Christian Stolarz, Brooklyn, NY (US); Christopher Xydis, New York City, NY (US); Ronald Ondrey, Bayonne, NJ (US); Eli Worden, New York City, NY (US); Charlie Paradise, Brooklyn, NY (US)

(73) Assignee: Helen of Troy Limited, Belleville, St. Michael (BB)

( * ) Notice: Subject to any disclaimer, the term of this patent is extended or adjusted under 35 U.S.C. 154(b) by 102 days.

(21) Appl. No.: 13/615,806

(22) Filed: Sep. 14, 2012

(65) Prior Publication Data

US 2014/0077534 A1 Mar. 20, 2014

(51) Int. Cl.
*A47D 1/00* (2006.01)
*A47B 83/02* (2006.01)

(52) U.S. Cl.
USPC ..... 297/149; 297/148; 297/153

(58) Field of Classification Search
USPC ..... 297/148, 149, 150, 151, 152, 153, 154, 297/155
See application file for complete search history.

(56) References Cited

U.S. PATENT DOCUMENTS 2,532,812 A 12/1950 Huber
4,582,359 A * 4/1986 Wise et al. ..... 297/153 X
4,723,813 A * 2/1988 Kassai ..... 297/153
4,842,331 A * 6/1989 Waples ..... 297/149
4,968,092 A 11/1990 Giambrone
5,238,292 A 8/1993 Golenz et al.
5,489,138 A * 2/1996 Mariol et al. ..... 297/153 X
5,823,615 A 10/1998 Haut
5,951,102 A 9/1999 Poulson et al.
6,416,124 B1 * 7/2002 Chen et al. ..... 297/149
6,419,312 B1 * 7/2002 Flannery et al. ..... 297/149
6,851,752 B2 2/2005 Asbach
7,066,542 B2 6/2006 Wang
7,419,210 B2 * 9/2008 Nolan et al. ..... 297/153
7,568,758 B2 * 8/2009 Troutman et al. ..... 297/148
7,810,885 B2 10/2010 Chen et al.
7,883,145 B2 * 2/2011 Troutman et al. ..... 297/148
7,918,497 B2 * 4/2011 Keegan ..... 297/149 X
7,922,244 B2 * 4/2011 Bearup ..... 297/153
8,029,053 B2 * 10/2011 Troutman et al. ..... 297/148
8,201,879 B2 * 6/2012 Hartenstine et al. ..... 297/153

* cited by examiner

*Primary Examiner* — Rodney B White
(74) *Attorney, Agent, or Firm* — Rankin, Hill & Clark LLP

(57) ABSTRACT

A highchair includes a seat assembly, a tray connected with the seat assembly, a leg assembly connected with the seat assembly, and an adjustment mechanism. The seat assembly includes a rear support surface and a lower support surface for supporting an infant or child. The leg assembly is configured to support the seat assembly above a floor surface. The adjustment mechanism can be for adjusting the tray with respect to the seat assembly or the seat assembly with respect to the leg assembly. The adjustment mechanism can include a button, a linkage, a cable, and a locking member.

20 Claims, 10 Drawing Sheets

HIGHCHAIR WITH ADJUSTABLE TRAY AND SEAT HEIGHT

BACKGROUND

Highchairs for infants and children typically include a seat supported above the floor and a tray attached to the seat upon which food and drink for the child can be placed. Oftentimes, the tray is removable from the seat for easy cleaning. Additionally, the tray can be adjusted with respect to the seat. These tray adjustment mechanisms, however, can be improved to be more intuitive and user friendly. Also, the height of the seat with respect to the ground can also be adjusted. These seat-height adjustment mechanisms can also be improved to be more intuitive and user friendly.

SUMMARY

A highchair than can overcome at least one of the aforementioned shortcomings includes a seat assembly, a tray connected with the seat assembly, a leg assembly connected with the seat assembly, and an adjustment mechanism. The seat assembly includes a rear support surface and a lower support surface for supporting an infant or child. The leg assembly is configured to support the seat assembly above a floor surface. The adjustment mechanism can be for adjusting the tray with respect to the seat assembly or the seat assembly with respect to the leg assembly.

Such an adjustment mechanism can include a button, a linkage, a cable, and a locking member. The button pivotally connects with the tray or the seat assembly. The linkage includes a first end and a second end, and the first end of the linkage is pivotally connected with the button. The cable also includes a first end and a second end, and the first end of the cable is connected with the second end of the linkage. The locking member connects with the second end of the cable and releasably couples with the seat assembly or the leg assembly. The locking member is moveable between a locked position, in which the locking member engages the seat assembly or the leg assembly, and unlocked position, in which the locking member is disengaged from the seat assembly or the leg assembly. Pivotal movement of the button about a button pivot axis results in pivotal movement of the linkage about a linkage pivot axis, which is spaced from the button pivot axis. Pivotal movement of the button about the button pivot axis also results in translational movement at the second end of the linkage, which results in movement of the cable in an unlocking direction. Movement of the cable in the unlocking direction results in movement of the locking member toward the unlocked position.

DETAILED DESCRIPTION

Figure 1:
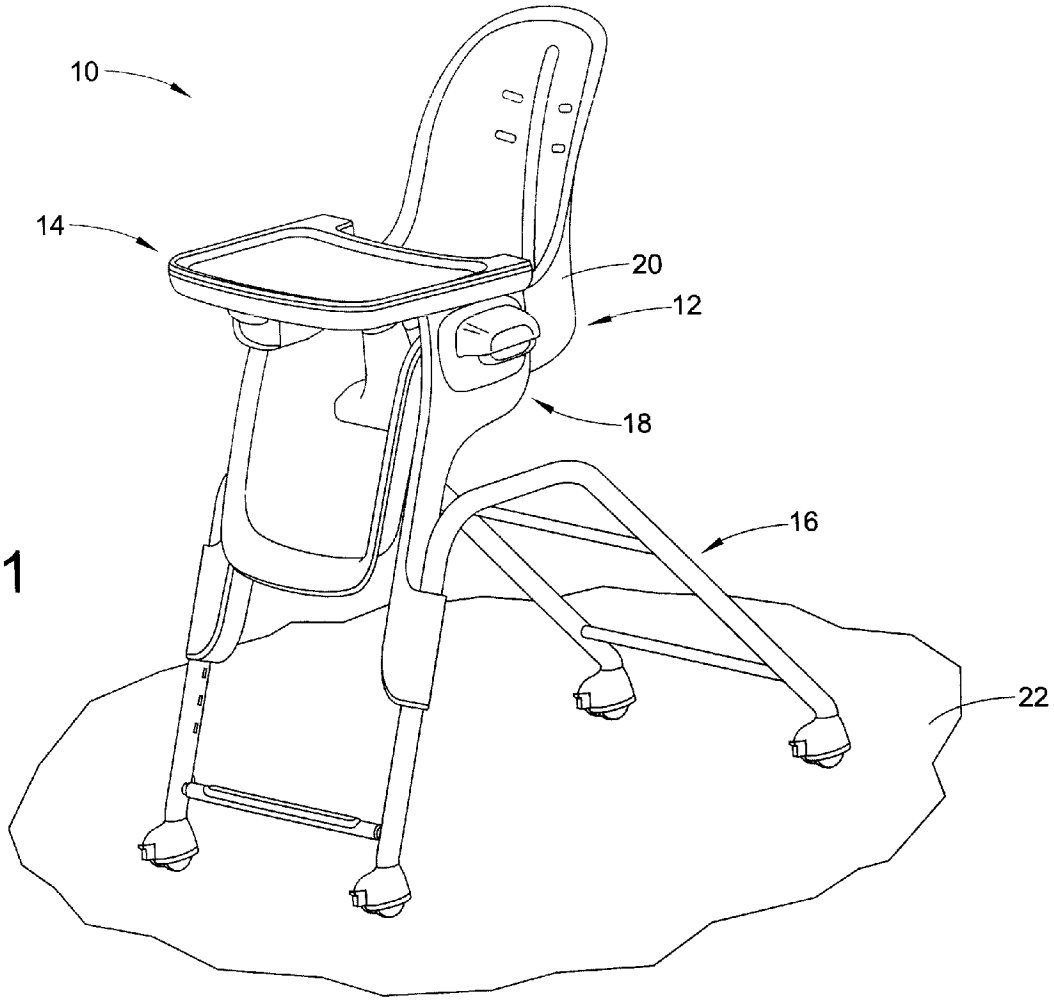
FIG. 1 is a front perspective view of a highchair.

FIG. 1 depicts a highchair 10 including a seat assembly 12, a tray 14 connected with the seat assembly 12, and a leg assembly 16 connected with the seat assembly 12. As illustrated, the seat assembly 12 includes a carriage 18 and a seat 20. The highchair 10 also includes at least one adjustment mechanism, which will be described in more detail below, for adjusting the tray 14 with respect to the seat assembly 12 or for adjusting the seat assembly 12 with respect to the leg assembly 16. Throughout the description and claims, the term "or" should be read as inclusive, unless the context clearly states otherwise. Each adjustment mechanism is designed to be intuitive and user friendly to allow for easy adjustment of the tray 14 with respect to the seat 20 or to allow for easy adjustment of the height of the seat 20 with respect to floor surface 22 upon which the highchair 10 rests.

Figure 2:
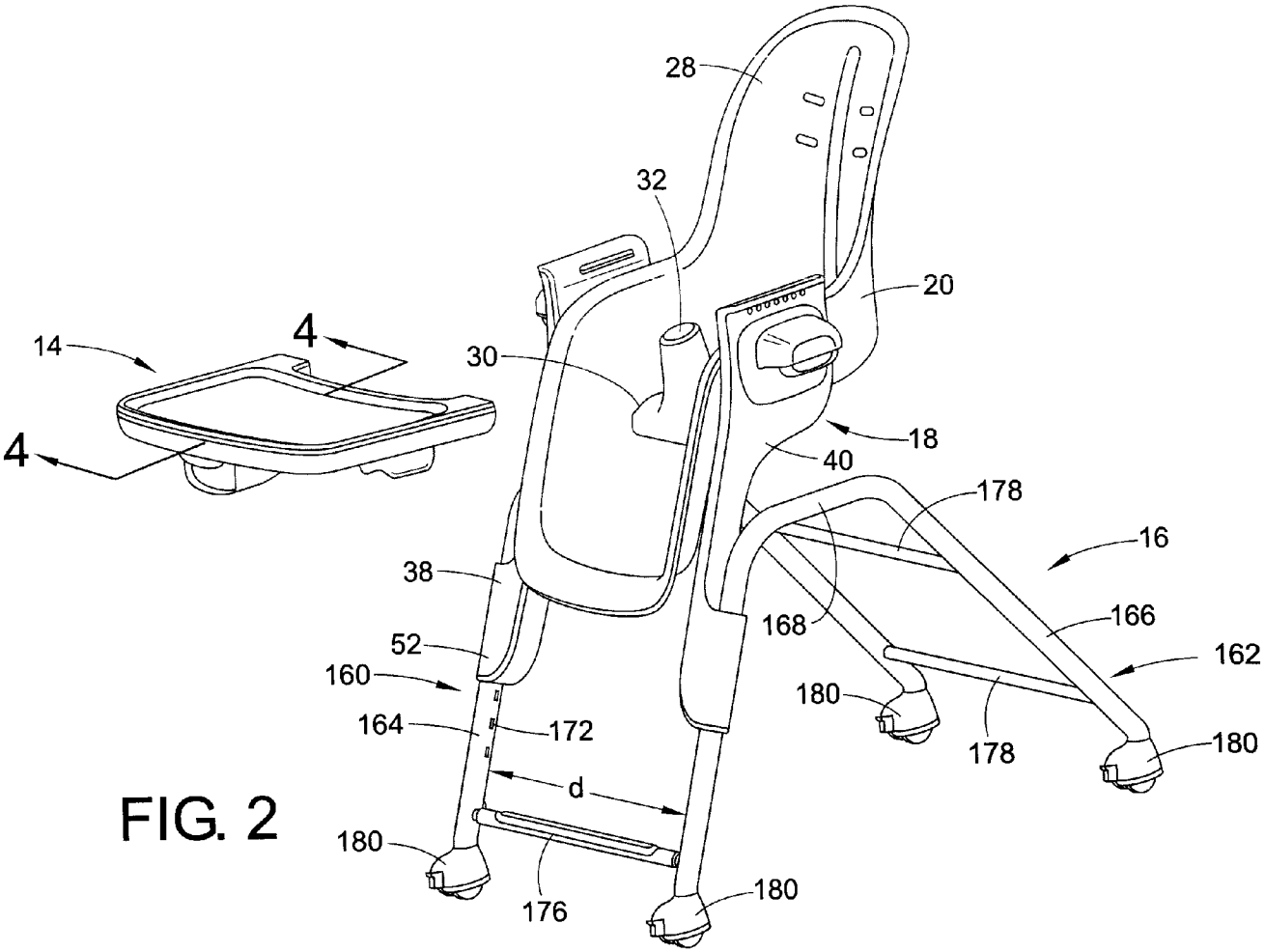
FIG. 2 is a front perspective view of the highchair depicted in FIG. 1 with a tray of the highchair removed from a remainder of the highchair.

As mentioned above, the seat assembly 12 includes the carriage 18 and the seat 20. With reference to FIG. 2, the seat 20 includes a rear support surface 28 for supporting the back of an occupant of the highchair 10 and a lower support surface 30 for supporting the rear and legs of the occupant. A crotch post 32 is also provided on the seat 20. The seat 20 is moveable with respect to the carriage 18. More particularly, the seat 20 can pivot with respect to the carriage 18 into a number of different reclined positions.

Figure 7:
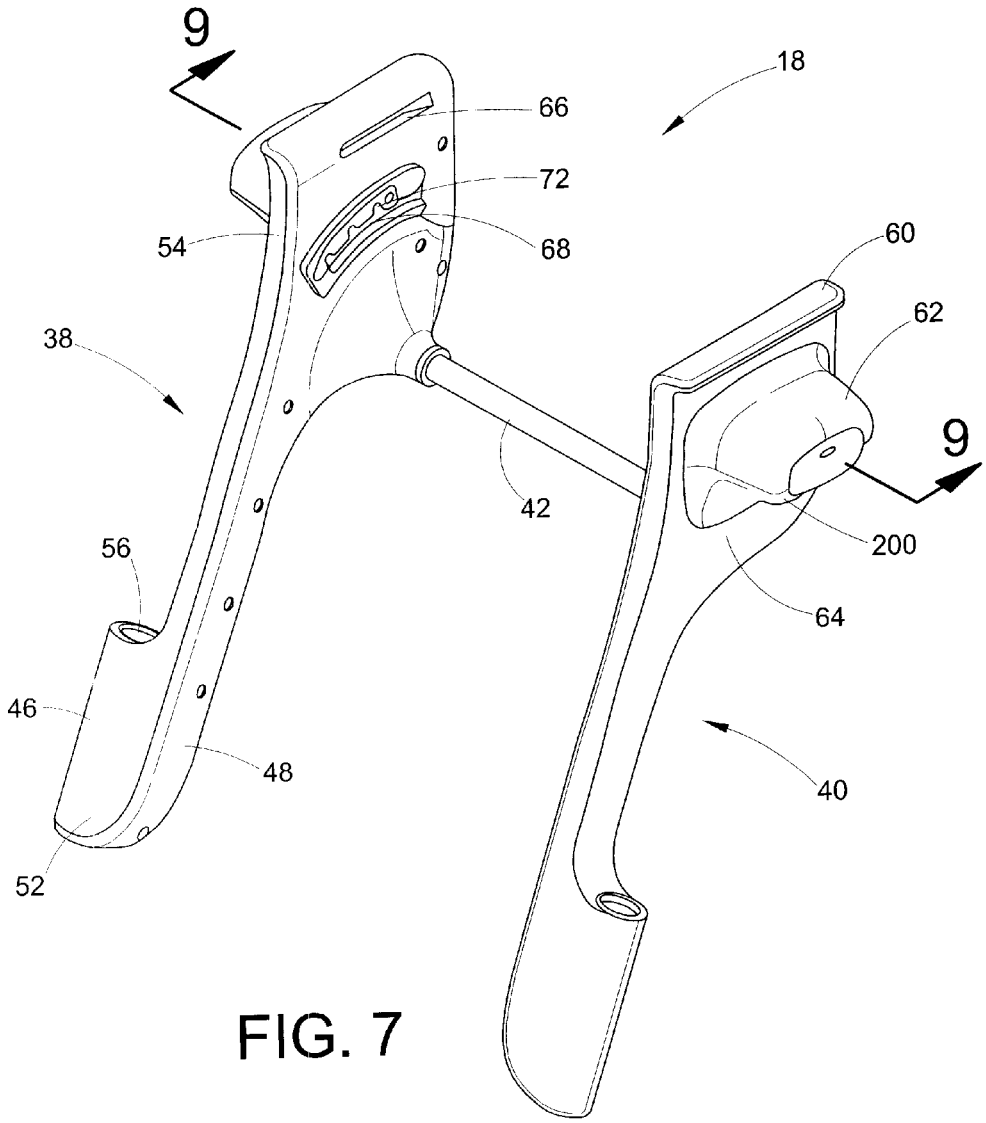
FIG. 7 is a perspective view of a carriage of the highchair depicted in FIG. 1.
Figure 8:
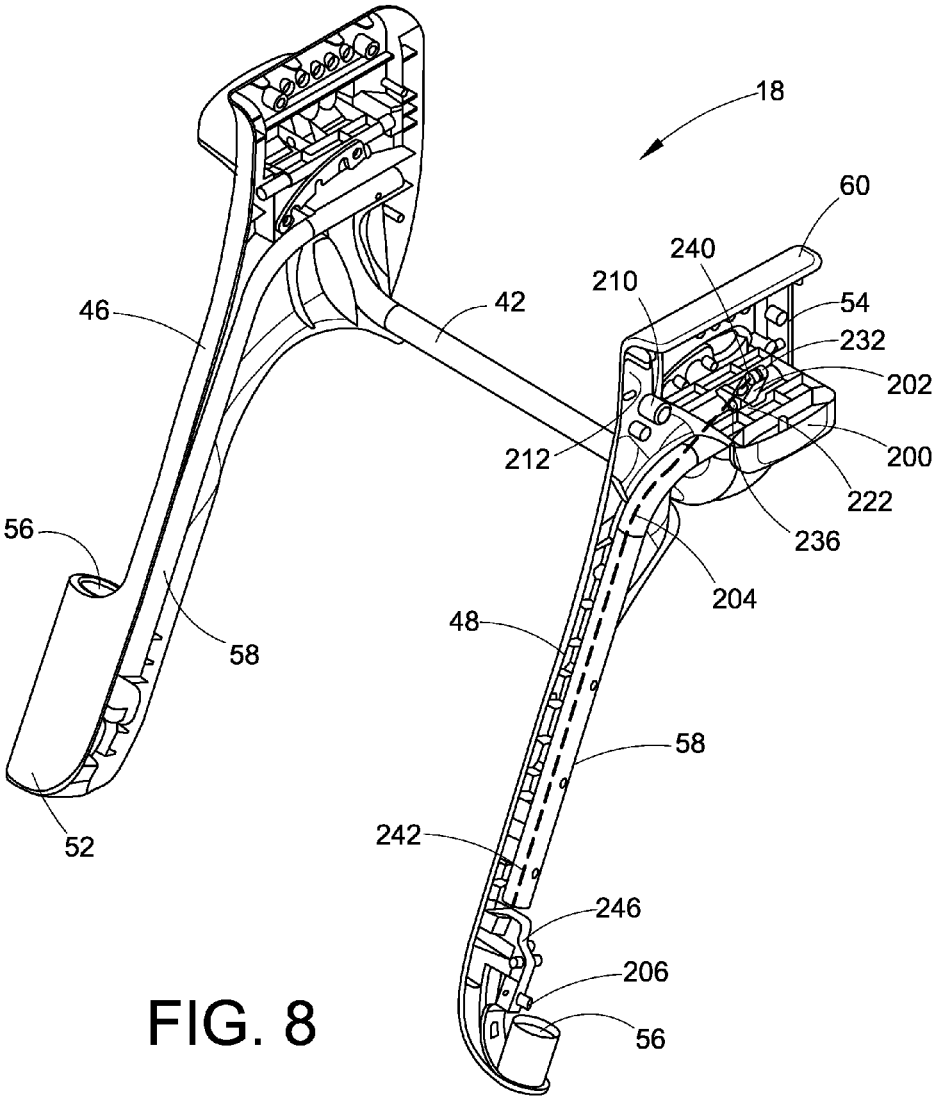
FIG. 8 is a perspective view of the carriage depicted in FIG. 7 with a left inner carriage member piece and a right outer carriage member piece removed from the carriage to show the internal components of the carriage.

With reference to FIGS. 7 and 8, the carriage 18 includes a left carriage support 38 a right carriage support 40, which are connected by a crossbar 42. The terms "left" and "right" are used to facilitate description of the highchair 10 with respect to the figures. These terms are relative to a person facing the highchair 10 so as to feed a child sitting in the highchair. The left carriage support 38 is a mirror image of the right carriage support 40. For the sake of brevity, the portion of each support that is visible in FIGS. 7 and 8 will be described with the understanding that the other support has the same structure. Also, like reference numbers will be used to described elements found on both supports.

Each support 38, 40 includes an outer piece 46 connected with an inner piece 48. The outer piece 46 and the inner piece 48 in the illustrated embodiment are made from plastic and house internal components. Each support 38, 40 also includes a lower end 52 and an upper end 54. The term "end" is not limited to the terminus of the component, but instead should be read to also include a region of the component adjacent the terminus. A passage 56 is formed near the lower end 52 of each support for connecting with the leg assembly 16 (FIG. 1). Tubular metal stock 58, which is connected with the crossbar 42 that is also made of similar tubular metal stock, is enclosed by the outer piece 46 and the inner piece 48 of each support 38, 40.

Each support 38, 40 includes an armrest flange 60 at the upper end 54. The arm rest flange 60 extends outwardly and is located with respect to the seat 20 such that the armrest flange can operate as an arm rest when the tray 14 is not attached (see FIG. 2). A shroud 62 extends outwardly from an outer surface 64 adjacent the upper end 54 of each support 38, 40. The carriage 18 also includes a plurality of tray adjustment holes 66 disposed along a generally horizontal direction. The tray adjustment holes 66 are disposed just beneath the armrest flange 60 and above the shroud 62 in each support 38, 40.

Each support 38, 40 also includes an arc-shaped notch 68 that leads into a plurality of recesses 72. The arch-shaped notch 68 is formed along a radius centered coaxially with a central axis of the crossbar 42. The seat 20 is supported by the crossbar 42 and can pivot about the central axis of the crossbar. An adjustment mechanism, similar to known adjustment mechanisms, can be used to position the chair in different reclined positions with respect to the carriage 18 by use of the arch-shaped notch 68 and recesses 72.

Figure 3:
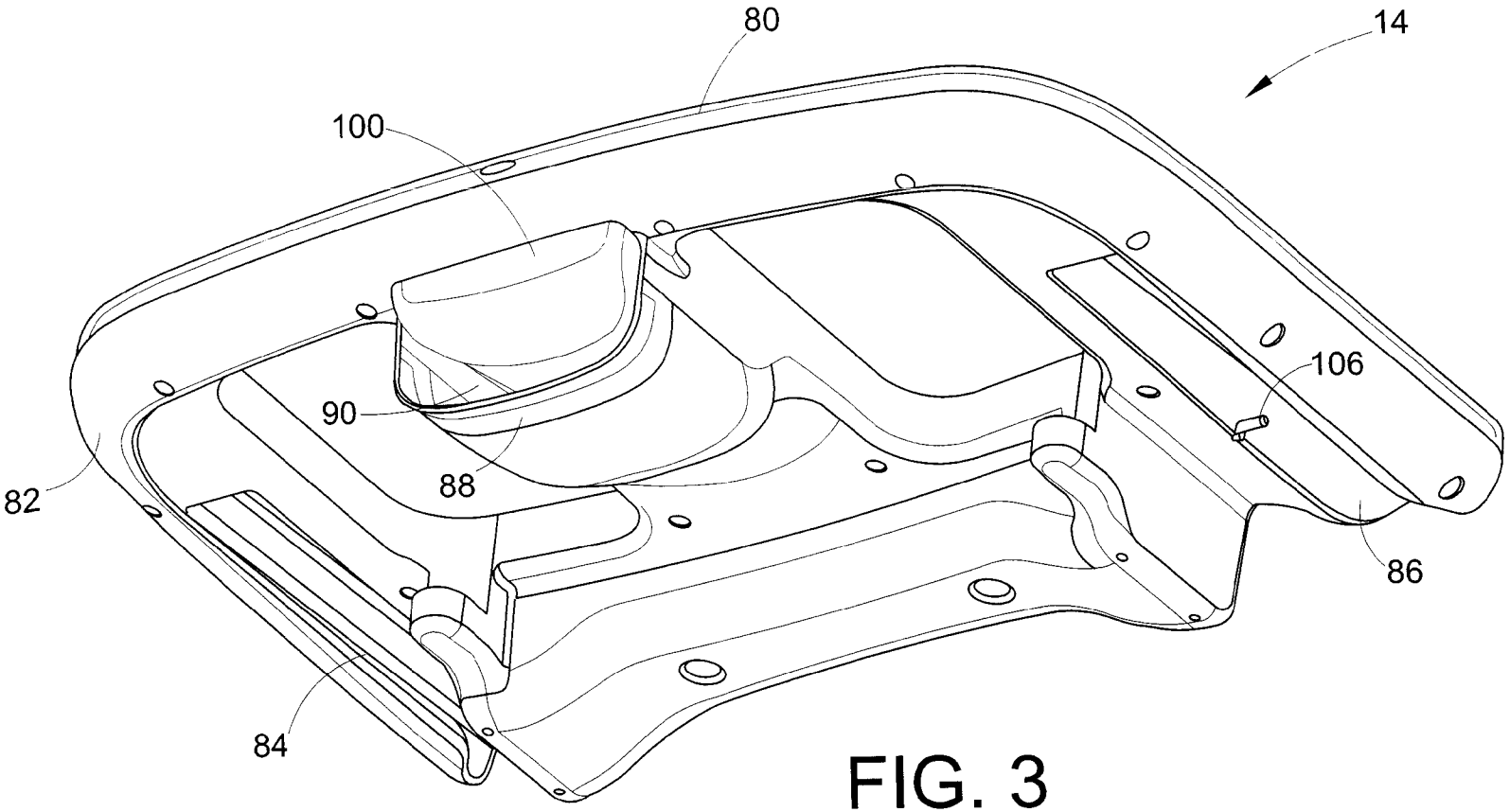
FIG. 3 is a perspective view of a lower side of the tray of the highchair depicted in FIG. 1.
Figure 4:
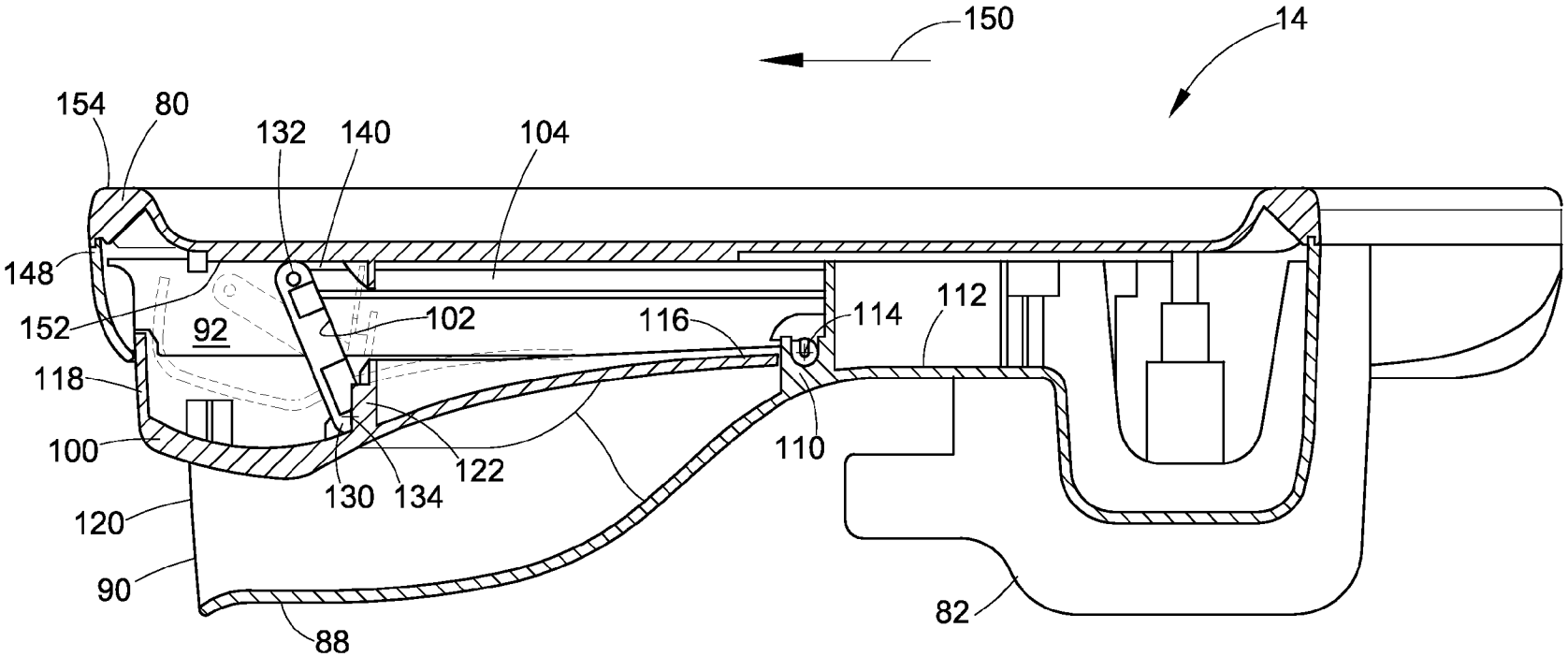
FIG. 4 is a cross-sectional view taken generally along line 4-4 in FIG. 2.
Figure 5:
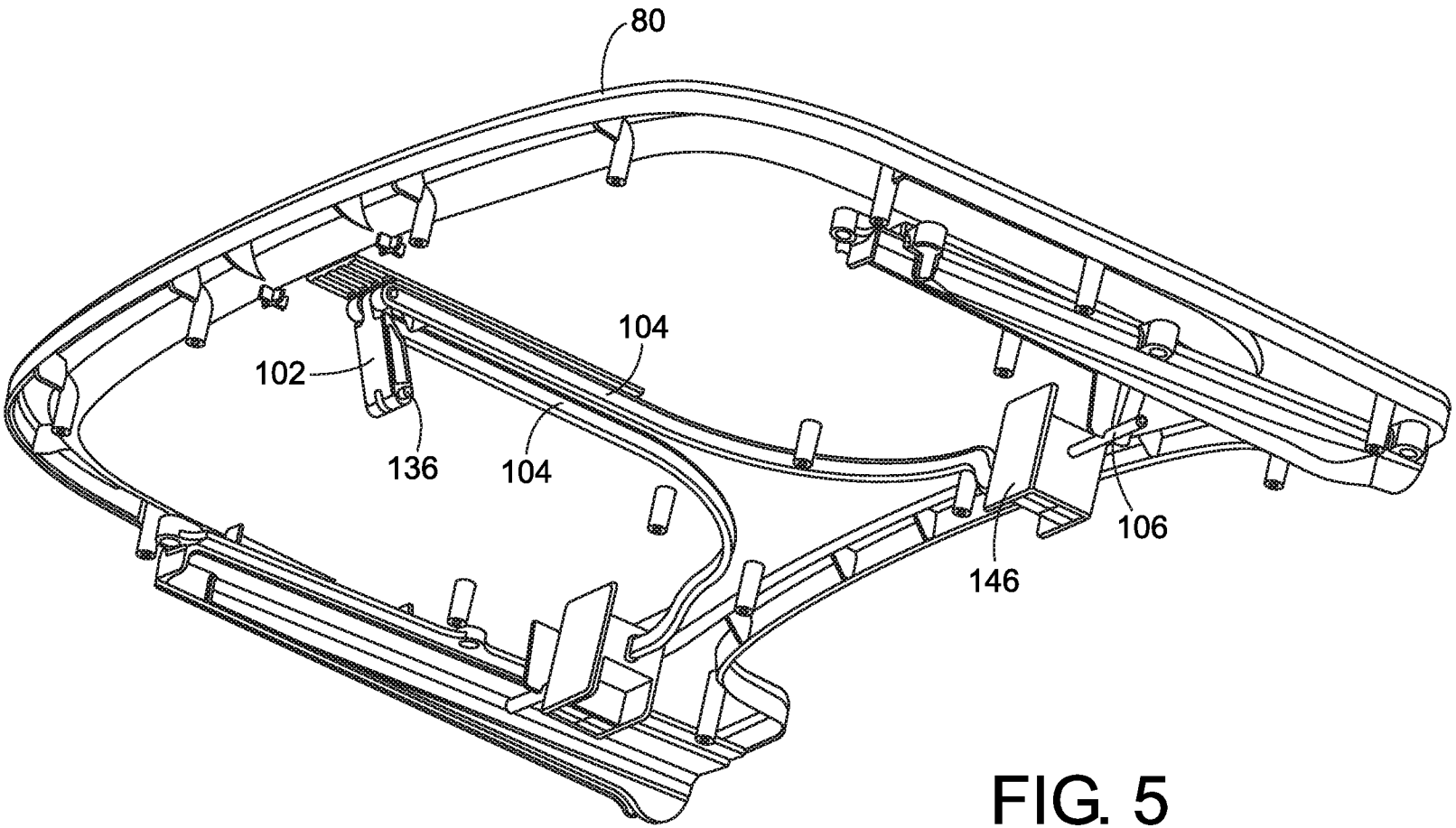
FIG. 5 is a perspective view of a lower side of the tray with a bottom piece of the tray removed to show internal components of the tray.
Figure 6:
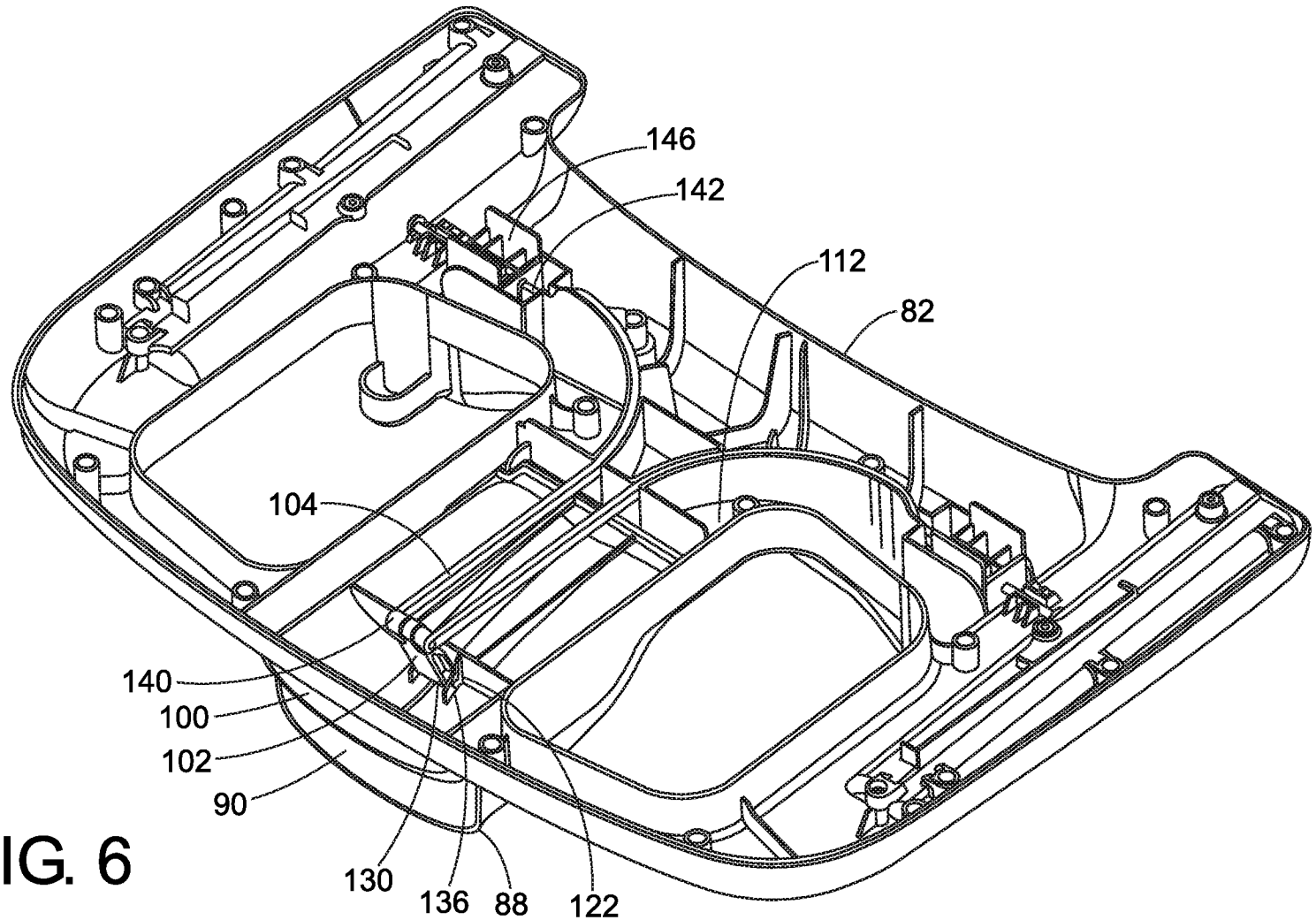
FIG. 6 is a perspective view of an upper side of the tray with a top piece of the tray removed to show the internal components.

With reference to FIGS. 3 and 4, the tray 14 includes a top piece 80 and a bottom piece 82. The tray 14 also includes left and right lower channels 84, 86, respectively. The left lower channel 84 is configured to receive the armrest flange 60 at the upper end 54 of the left support 38 of the carriage 18 and the right lower channel 86 is configured to receive the armrest flange 60 at the upper end 54 of the right support 40 of the carriage 18. The left lower channel 84 and the right lower channel 86 are formed at opposite sides of the tray 14 and are formed in the bottom piece 82 in the illustrated embodiment. The tray 14 also includes a lower shroud 88 that defines a forward opening 90. The lower shroud 88 is integrally formed with the bottom piece 82.

The tray 14 also includes a tray adjustment mechanism for adjusting the tray 14 with respect to the seat assembly 12. The top piece 80 of the tray 14 connects with the bottom piece 82 to define a hollow interior 92, which can house some components of the tray adjustment mechanism. With reference to FIGS. 3-6, the tray adjustment mechanism includes a button 100, a linkage 102, a cable 104, and a locking member 106. Upward pivotal movement of the button 100 results in translational movement of the linkage 102, which results in movement of the locking member 106, which allows for adjustment of the tray 14 with respect to the seat assembly 12.

With reference to FIG. 4, the button 100, which can also be referred to as a tray adjustment button, pivotally connects with the tray 14. The button 100 connects with a mount 110 formed on an internal surface 112 of the bottom piece 82 of the tray 14. The button 100 pivots about a button pivot axis 114. The button 100 includes a proximal end 116 adjacent to the button pivot axis 114 and a distal end 118 spaced from the proximal end 116. The button 100 connects with the tray 14 at the proximal end 116. The button 100 further includes a contact surface 120, which is configured to be pressed against by an operator to pivot the button about the button pivot axis 114. As evident in FIG. 4, the contact surface 120 is disposed below the button pivot axis 114 and near the distal end 118. Also, the contact surface 120 is substantially covered by the shroud 88 and access to the contact surface 120 is provided through the opening 90. The button 100 further includes a linkage mount 122 integrally formed with the button 100. The linkage mount 122 provides a location to connect the linkage 102 with the button 100.

The linkage 102 includes a first end 130 and a second end 132. The first end 130 of the linkage 102 is pivotally connected with the button 100. As more clearly seen in FIG. 6, in the illustrated embodiment, the linkage mount 122 on the button 100 receives an axle 136 connected with the first end 130 of the linkage 102. Pivotal movement of the button 100 about the button pivot axis 114 results in pivotal movement of the linkage 102 about a linkage pivot axis 134, which is spaced from the button pivot axis. The axle 136, which connects the linkage 102 with the button 100, is coaxial with the linkage pivot axis 134. The linkage pivot axis 134 is parallel to the button pivot axis 114 and adjacent to the first end 130 of the linkage 102. Pivotal movement of the button 100 about the button pivot axis 114 results in movement of the linkage pivot axis 134 about an arc having a radius emanating from the button pivot axis 114.

The tray 14 depicted in the figures includes two cables 104. Each cable 104 is similar and therefore similar reference numerals will be used for the cables. Each cable 104 includes a first end 140 and a second end 142. The first end 140 of the cable 104 is connected with the second end 132 of the linkage 102. The locking member 106 is connected with the second end 142 of the cable 104 through a biasing mechanism 146, which biases the locking member 106 into the respective lower channels 84, 86 of the tray 14 for receipt in the tray adjustment holes 66 found in the carriage 18. This allows the locking member 106 to be releasably coupled with the seat assembly 12. The locking member 106 is moveable between a locked position where the locking member 106 engages the seat assembly 12 and an unlocked position where the locking member 106 is disengaged from the seat assembly 12. In the locked position, the locking member 106 fits into one of the tray adjustment holes 66. In the unlocked position, the locking member is moved out of the respective tray adjustment hole 66.

With reference to FIG. 4, pivotal movement of the button 100 about the button pivot axis 114 results in pivotal movement of the linkage 102 about the linkage pivot axis 134. Pivotal movement of the button 100 about the button pivot axis 114 also results in translational movement at the second end 132 of the linkage 102, which results in movement of the cable 104 in an unlocking direction 150. Movement of the cable 104 in the unlocking direction 150 results in movement of the locking member 106 toward the unlocked position, which is the position in which the locking member 106 is disengaged from the seat assembly 12 and more particularly the carriage 18 of the seat assembly. Upward pivotal movement of the distal end 118 of the button 100 results in translational movement of the second end 132 of the linkage 102 toward the proximal end 118 of the button 100. The linkage 102 is moveable between a first position (shown in solid lines in FIG. 4) and a second position (shown in dashed lines in FIG. 4). When the linkage is in the first position, the locking member 106 is in the locked position. When the linkage 102 is in the second position, the locking member 106 is in the unlocked position. When the linkage is in the first position, the second end 132 of the linkage 102 is closer to the distal end 118 of the button 100 as compared to the first end 130 of the linkage 102. This allows the desirable movement of the second end 132 of the linkage 102 toward a forward edge 148 of the tray 14 which results in a tensile force being applied to the cable 104 which draws the cable in the unlocking direction 150. As the distal end 118 of the button 100 is moved upwards, the second end 132 of the linkage 102 contacts a lower surface 152 of the top piece 80 of the tray 14. The second end 132 of the linkage 102 rides along the lower surface 152 of the top piece 80 as the distal end of the button 100 continues to be moved upward.

To adjust the tray 14 with respect to the seat assembly 12, an operator inserts her fingers through the opening 90 between the shroud 88 and the contact surface 120 of the button 100. The operator can place her thumb on an upper surface 154 of the top piece 80 of the tray 14. The operator then pushes upward with her fingers on the contact surface of the button 100. This results in the button 100 rotating about the button pivot axis 114. As the button 100 rotates about the button pivot axis 114, the linkage 102 pivots about the linkage pivot axis 134 and translates along the lower surface 152 of the top piece 80 of the tray 14. The second end 132 of the linkage 122 moves in a generally linear direction toward a front end of the tray 14 pulling the cable 104 in the unlocking direction 150. This results in the locking members 106, which can also be referred to as tray locking members, to disengage from the tray adjustment holes 66 formed in the carriage 18. Since the tray locking members 106 are configured to be received in each tray adjustment hole 66, the tray 14 can be adjusted in a horizontal direction with respect to the seat 20 and the carriage 18 by the upward movement of the button 100 and then horizontal movement of the tray 14.

With reference back to FIG. 1, the leg assembly 16 is connected with the seat assembly 12 and is configured to support the seat assembly 12 above the floor surface 22. With reference to FIG. 2, the leg assembly 16 includes a left leg member 160 that is a mirror image of a right leg member 162. As such, the visible portions of each leg member 160, 162 will be described with the understanding that the other leg member has the same structure. Also, like reference numbers will be used to describe elements found in each leg member. Each leg member 160, 162 is made from a tubular metal stock, which as illustrated is bent in a general upside down U-shape.

Each leg member includes a front section 164, a rear section 166, and a central section 168 that interconnects the front section 164 to the rear section 166. In the illustrated embodiment, the front section 164 is generally inclined forwardly and the rear section 166 is generally inclined rearwardly. The central section 168 is generally horizontal. The left leg member 160 is spaced from the right leg member 162 a distance d. The front section 164 also includes a plurality of seat-height adjustment holes 172 disposed along a generally vertical direction.

The left leg member 160 connects with the right leg member 162 by way of a forward cross member 176 and two rear cross members 178. The forward cross member 176 is disposed vertically beneath the seat-height adjustment holes 172 and interconnects the respective forward sections 164 of the left leg member 160 and the right leg member 162. Wheel assemblies 180 are disposed at ends of each of the leg members 160 and 162 to allow for the highchair 10 to be easily maneuvered across the floor surface 22.

The carriage 18 connects with the leg assembly 16. As mentioned above, the carriage 18 includes left and right supports 38, 40 connected to the leg assembly at the lower end 52 of each support. A seat-height adjustment mechanism is carried by the carriage 18 to adjust the height of the seat 20 with respect to the floor surface 22.

Figure 9:
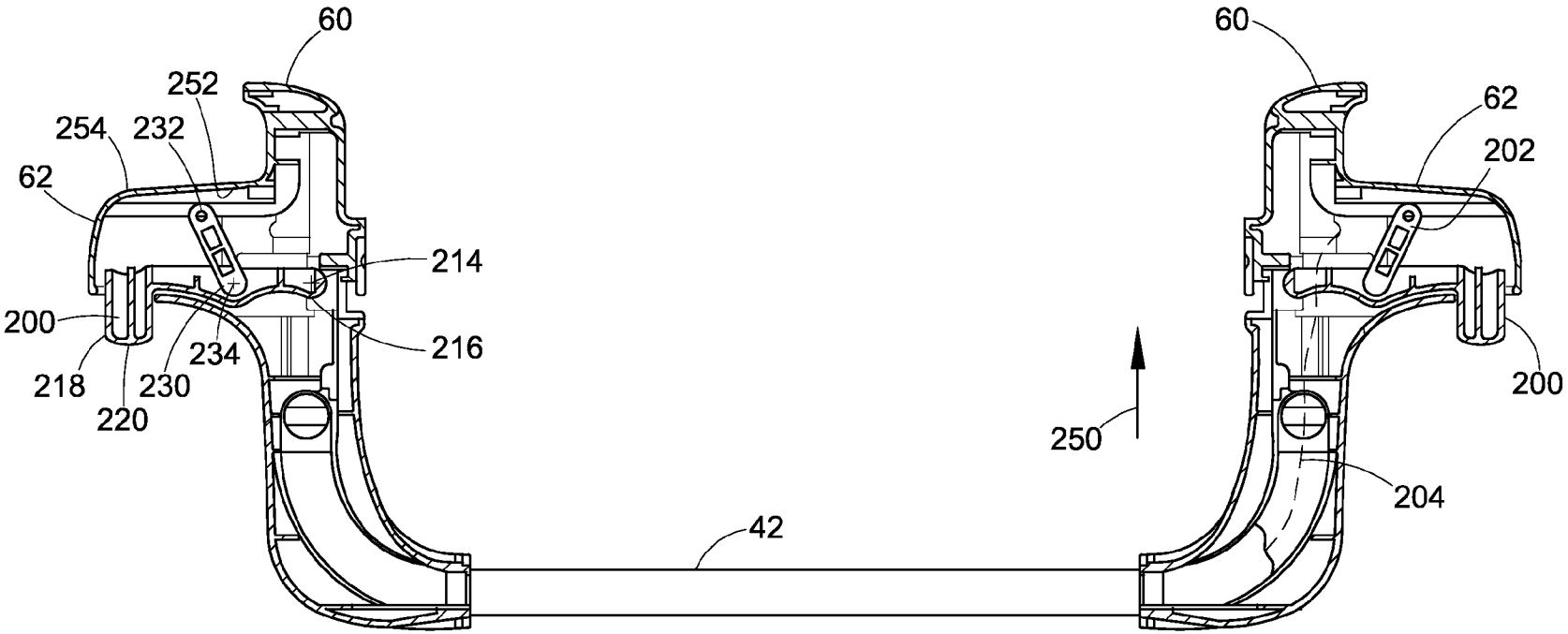
FIG. 9 is a cross-sectional view taken generally along line 9-9 in FIG. 7.

With reference to FIGS. 7-9, the seat height adjustment mechanism includes a button 200, a linkage 202, a cable 204, and a locking member 206. The button 200, which can also be referred to as a seat-height adjustment button, is located adjacent the upper end 54 of each support 38, 40 of the carriage 18. The seat-height adjustment button 200 is located on the outer surface 64 of each support 38, 40. The shroud 62 extends outwardly from the outer surface 64 of the support 38, 40 and covers the seat-height adjustment button 200. A portion of the tray 14 is disposed between the armrest flange 60 and the shroud 62 when the tray is connected with the carriage 18. Locating the seat-height adjustment button adjacent the upper end 54 of each support 38, 40 allows for an operator to easily adjust the seat height 20 with respect to the ground surface 22 by providing the button in a convenient location. The seat-height adjustment button 200 operates in a manner similar to the tray adjustment button 100 described above.

With reference to FIG. 8, the seat-height adjustment button 200 pivotally connects with the seat assembly 12. The button 200 (two seat-height adjustment buttons are provided in the illustrated embodiment) connects with a mount 210 formed on an internal surface 212 of the inner piece 48 of each support 38, 40. With reference to FIG. 9, the button 200 pivots about a button pivot axis 214. The button 200 includes a proximal end 216 adjacent to the button pivot axis 214 and a distal end 218 spaced from the proximal end 216. The button 200 connects with each support 38, 40 of the carriage 18 at the proximal end 216. The button 200 further includes a contact surface 220, which is configured to be pressed upward to pivot the button about the button pivot axis 214. The contact surface 220 is disposed below the button pivot axis 214 and near the distal end 218. The button 200 further includes a linkage mount 222 integrally formed with the button 200. The linkage mount 222 provides a location to connect the linkage 202 with the button 200.

The linkage 202 includes a first end 230 and a second end 232. The first end 230 of the linkage 202 is pivotally connected with the button 200. As more clearly seen in FIG. 8, the linkage mount 222 on the button 200 receives an axle 236 connected with the first end 230 of the linkage 202. Pivotal movement of the button 200 about the button pivot axis 214 results in pivotal movement of the linkage 202 about a linkage pivot axis 234, which is spaced from the button pivot axis. The axle 236, which connects the linkage 202 with the button 200, is coaxial with the linkage pivot axis 234. The linkage pivot axis 234 is parallel to the button pivot axis 214 and adjacent to the first end 230 of the linkage 202. Pivotal movement of the button 200 about the button pivot axis 214 results in movement of the linkage pivot axis 234 about an arc having a radius emanating from the button pivot axis 214.

The carriage 18 includes two cables 204: one cable connects with the button 200 on the left support 38 and one cable connects with the button 200 on the right support 40 of the carriage. Each cable 204 is similar and therefore similar reference numerals will be used for the cables. Each cable 204 includes a first end 240 and a second end 242. The first end 240 of the cable 204 is connected with the second end 232 of the linkage 202. The locking member 206 is connected with the second end 242 of the cable 204 through a biasing mechanism 246, which biases the locking member 206 into the passage 56 of each support 38, 40 for receipt in the seat-height adjustment holes 172 found in the leg members 160, 162. This allows the locking member 206 to be releasably coupled with the leg assembly 16. The locking member 206 is moveable between a locked position where the locking member 206 engages the leg assembly 16 and an unlocked position where the locking member 206 is disengaged from the leg assembly 16. In the locked position, the locking member 206 fits into one of the seat-height adjustment holes 172. In the unlocked position, the locking member is moved out of the respective seat-height adjustment hole 172.

With reference to FIG. 9, pivotal movement of the button 200 about the button pivot axis 214 results in pivotal movement of the linkage 202 about the linkage pivot axis 234. Pivotal movement of the button 200 about the button pivot axis 214 also results in translational movement at the second end 232 of the linkage 202, which results in movement of the cable 204 in an unlocking direction 250. Movement of the cable 204 in the unlocking direction 250 results in movement of the locking member 206 toward the unlocked position, which is the position in which the locking member 206 is disengaged from the leg assembly 16 and more particularly each leg member 160, 162 of the leg assembly. Upward pivotal movement of the distal end 218 of the button 200 results in translational movement of the second end 232 of the linkage 202 toward the proximal end 218 of the button 200. The linkage 202 is moveable between a first position (shown in FIG. 9) and a second position (similar to the linkage 102 shown in dashed lines in FIG. 4). When the linkage 202 is in the first position, the locking member 206 is in the locked position. When the linkage 202 is in the second position, the locking member 206 is in the unlocked position. When the linkage 202 is in the first position, the second end 232 of the linkage 202 is closer to the distal end 218 of the button 200 as compared to the first end 230 of the linkage 202. As the distal end 218 of the button 200 is moved upwards, the second end 232 of the linkage 202 contacts a lower surface 252 of the shroud 62. The second end 232 of the linkage 202 rides along the lower surface 252 of the shroud 62 as the distal end 218 of the button 200 continues to be moved upward.

Figure 10:
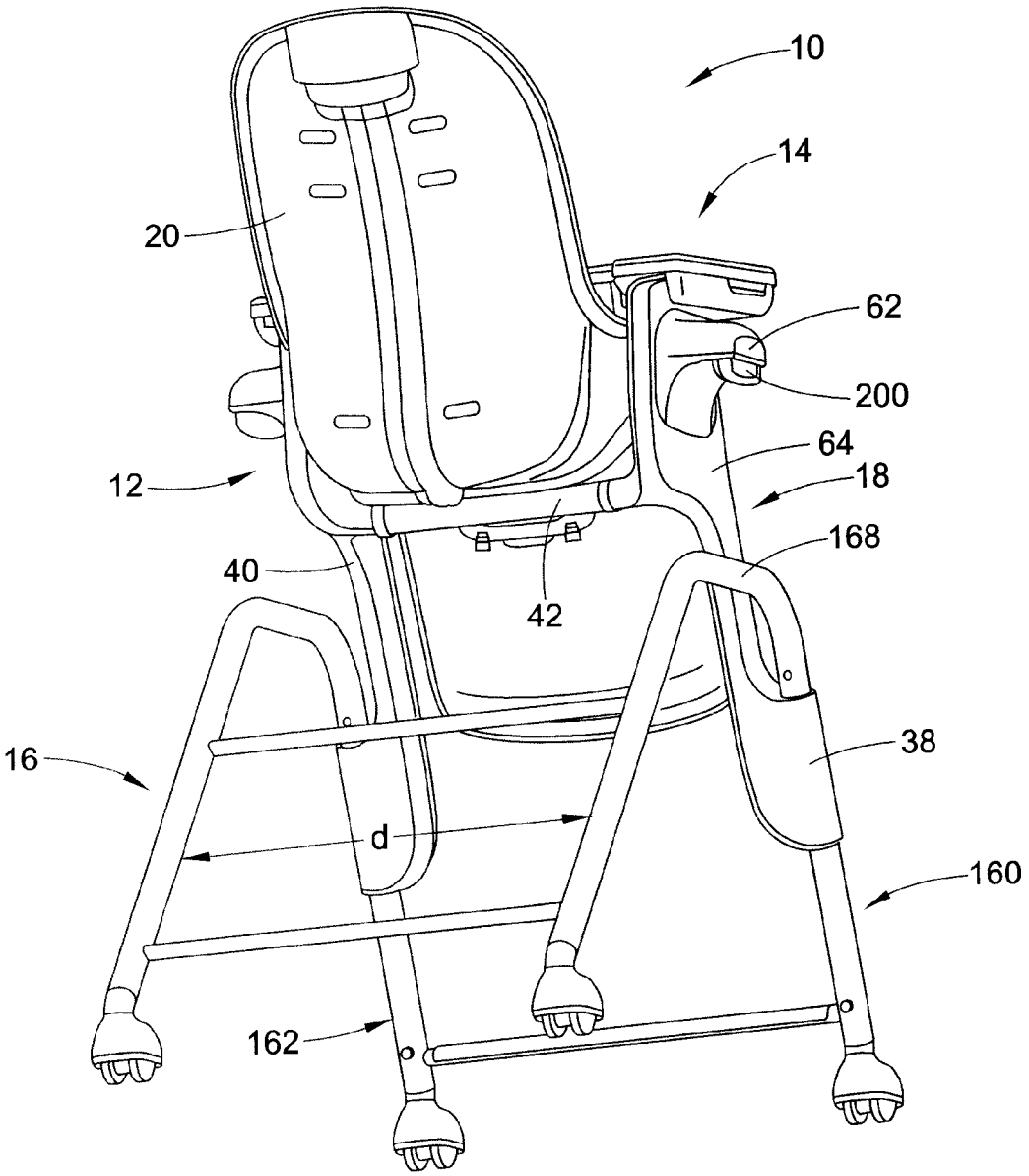
FIG. 10 is a rear perspective view of the high chair depicted in FIG. 1.

To adjust the seat assembly 12 with respect to the leg assembly 16, an operator presses upwardly against the contact surface 220 of the button 200. The operator can place her thumb of the same hand on the upper surface 154 of the top piece 80 of the tray 14 or on an upper surface 254 of the shroud 62. The operator then pushes upward with her fingers on the contact surface of the button 200. This results in the button 200 rotating about the button pivot axis 214. As the button 200 rotates about the button pivot axis 214, the linkage 202 pivots about the linkage pivot axis 234 and translates along the lower surface 252 of the shroud 62. The second end 232 of the linkage 222 moves in a generally linear direction toward an outer end of the shroud 62 pulling the cable 204 in the unlocking direction 250. This results in the locking members 206, which can also be referred to as seat-height locking members, to disengage from the seat-height adjustment holes 172 formed in the leg assembly 16. Since the tray locking members 206 are configured to be received in each seat-height adjustment hole 172, the seat assembly 12, and more particularly the seat 20, can be adjusted in a generally vertical direction with respect to the leg assembly 16 and the floor surface 22 by the upward movement of the button 200 and then vertical movement of the seat assembly 18. As evident in FIG. 10, the distance d between the left leg member 160 and the right leg member 162 is greater than the distance between the outer surface 64 of the left support 38 and the outer surface 64 of the right support 40 of the carriage 18 between the shroud 62 and the passage 56 that receives a respective leg member 160,162. This allows the seat 20 to be lowered to a height nearly aligned with the central section 168 of each leg member 160, 162 of the leg assembly 16.

A highchair has been described above with particularity. Modifications and alterations will occur to those upon reading and understanding the preceding detailed description. The invention, however, is not limited to only the embodiment described above. Instead, the invention is broadly defined by the appended claims and the equivalents thereof. It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A high chair comprising:

a seat assembly including a rear support surface and a lower support surface;

a tray connected with the seat assembly;

a leg assembly connected with the seat assembly, the leg assembly being configured to support the seat assembly above a floor surface;

a button pivotally connected with the tray or the seat assembly;

a linkage including a first end and a second end, the first end of the linkage being pivotally connected with the button, wherein pivotal movement of the button about a button pivot axis results in pivotal movement of the linkage about a linkage pivot axis, which is spaced from the button pivot axis;

a cable including a first end and a second end, the first end of the cable being connected with the second end of the linkage, wherein pivotal movement of the button about the button pivot axis results in translational movement at the second end of the linkage, which results in movement of the cable in an unlocking direction;

a locking member connected with the second end of the cable and releasably coupled with the seat assembly or the leg assembly, the locking member being moveable between a locked position where the locking member engages the seat assembly or the leg assembly and an unlocked position where the locking member is disengaged from the seat assembly or the leg assembly, wherein movement of the cable in the unlocking direction results in movement the locking member toward the unlocked position.

2. The high chair of claim 1, wherein the linkage pivot axis is parallel to the button pivot axis and adjacent the first end of the linkage.

3. The high chair of claim 1, wherein the button includes a proximal end adjacent to the button pivot axis and a distal end spaced from the proximal end, wherein the button connects with the tray or the seat assembly at the proximal end, wherein upward pivotal movement of the distal end of the button results in translational movement of the second end of the linkage toward the proximal end of the button.

4. The high chair of claim 1, wherein the button includes a proximal end adjacent to the button pivot axis and a distal end spaced from the proximal end, wherein the linkage is movable between a first position and a second position, when the linkage is in the first position the locking member is in the locked position, when the linkage is in the second position the locking member in the unlocked position, when the linkage is in the first position the second end of the linkage is closer to the distal end of the button as compared to the first end of the linkage.

5. The high chair of claim 1, wherein the button includes a proximal end adjacent to the button pivot axis and a distal end spaced from the proximal end, wherein the button further includes a contact surface configured to be pressed against by an operator to pivot the button about the button pivot axis, wherein the contact surface is disposed below the button pivot axis.

6. The high chair of claim 1, wherein the button includes a mount integrally formed with the button, wherein the mount receives an axle connected with the first end of the linkage and coaxial with the linkage pivot axis.

7. The high chair of claim 1, wherein the tray includes a top piece and a bottom piece which when connected define a hollow interior, wherein the second end of the linkage contacts a lower surface of the top piece.

8. The high chair of claim 1, wherein the button includes a tray-adjusting button pivotally connected with the tray and the seat assembly includes a carriage and a seat, which includes the rear support surface and the lower support surface, connected with the carriage, wherein the locking member includes a tray locking member that engages the carriage when in the locked position.

9. The high chair of claim 8, wherein the carriage includes a plurality of tray adjustment holes disposed along a generally horizontal direction, wherein the tray locking member is configured to be received in each tray adjustment hole.

10. The high chair of claim 1, wherein the seat assembly includes a carriage and a seat, which includes the rear support surface and the lower support surface, connected with the carriage, wherein the button includes a seat-height adjustment button pivotally connected with the carriage and the locking member includes a seat-height locking member that engages the leg assembly when in the locked position.

11. The high chair of claim 10, wherein the leg assembly includes a plurality of seat-height adjustment holes disposed along a generally vertical direction, wherein the seat-height locking member is configured to be received in each seat-height adjustment hole.

12. The high chair of claim 10, wherein the carriage includes a support connected to the leg assembly at a lower end of the support, wherein the seat-height adjustment button is located adjacent an upper end of the support on an outer surface of the support.

13. The high chair of claim 12, wherein the support includes an arm rest flange at the upper end and a shroud extending outwardly from the outer surface of the support and covering the seat-height adjustment button, wherein a portion of the tray is disposed between the arm rest flange and the shroud when the tray is connected with the carriage.

14. The high chair of claim 12, wherein the second end of the linkage contacts a lower surface of the shroud.

15. The high chair of claim 1, wherein the seat assembly includes a carriage and a seat, which includes the rear support surface and the lower support surface, connected with the carriage, wherein the button pivotally connected with the seat assembly includes a tray adjustment button and a seat-height adjustment button, wherein the linkage includes a first linkage pivotally connected with the tray adjustment button and a second linkage pivotally connected with the seat-height adjustment button, wherein the cable includes a first cable connected with the first linkage and a second cable connected with the second linkage, wherein the locking member includes tray locking member that engages the carriage when in the locked position and a seat-height locking member that engages the leg assembly when in the locked position.

16. A high chair comprising:

a seat assembly including a rear support surface and a lower support surface;

a tray connected with the seat assembly;

a button pivotally connected with the tray;

a linkage including a first end and a second end, the first end of the linkage being pivotally connected with the button, wherein upward pivotal movement of the button about a button pivot axis results in pivotal movement of the linkage about a linkage pivot axis;

a cable including a first end and a second end, the first end of the cable being connected with the second end of the linkage, wherein the upward pivotal movement of the button about the button pivot axis results in translational movement at the second end of the linkage toward a forward edge of the tray, which results in movement of the cable in an unlocking direction;

a locking member connected with the second end of the cable and releasably coupled with the seat assembly, the locking member being moveable between a locked position where the locking member engages the seat assembly and an unlocked position where the locking member is disengaged from the seat assembly, wherein movement of the cable in the unlocking direction results in movement the locking member toward the unlocked position.

17. The high chair of claim 16, wherein the button includes a proximal end adjacent to the button pivot axis and a distal end spaced from the proximal end, wherein the linkage is movable between a first position and a second position, when the linkage is in the first position the locking member is in the locked position, when the linkage is in the second position the locking member in the unlocked position, when the linkage is in the first position the second end of the linkage is closer to the distal end of the button as compared to the first end of the linkage.

18. A high chair comprising:

a seat assembly including a rear support surface and a lower support surface;

a leg assembly connected with the seat assembly, the leg assembly being configured to support the seat assembly above a floor surface;

a button pivotally connected with the seat assembly;

a linkage including a first end and a second end, the first end of the linkage being pivotally connected with the button, wherein pivotal movement of the button about a button pivot axis results in pivotal movement of the linkage about a linkage pivot axis;

a cable including a first end and a second end, the first end of the cable being connected with the second end of the linkage, wherein pivotal movement of the button about the button pivot axis results in translational movement at the second end of the linkage, which results in movement of the cable in an unlocking direction;

a locking member connected with the second end of the cable and releasably coupled with the leg assembly, the locking member being moveable between a locked position where the locking member engages the leg assembly and an unlocked position where the locking member is disengaged from the leg assembly, wherein movement of the cable in the unlocking direction results in movement the locking member toward the unlocked position.

19. The high chair of claim 18, wherein the seat assembly includes a carriage and a seat, which includes the rear support surface and the lower support surface, connected with the carriage, wherein the carriage includes a support connected to the leg assembly at a lower end of the support, wherein the seat-height adjustment button is located adjacent an upper end of the support on an outer surface of the support.

20. The high chair of claim 19, wherein the support includes an arm rest flange at the upper end and a shroud extending outwardly from the outer surface of the support and covering the button, wherein the second end of the linkage contacts a lower surface of the shroud.

* * * * *